US005177829A

United States Patent [19]

Simpson

[11] Patent Number: 5,177,829

[45] Date of Patent: Jan. 12, 1993

[54] PERSONAL HYGIENE DEVICE

[76] Inventor: Sean D. Simpson, 782 Granite Hill Cir., El Cajon, Calif. 92019

[21] Appl. No.: 708,702

[22] Filed: May 31, 1991

[51] Int. Cl.[5] ..... A47K 7/03; A61H 33/00

[52] U.S. Cl. ..... 15/104.92; 15/161; 4/622; 4/628; 222/209; 401/6; 401/183

[58] Field of Search ..... 128/62 R, 66, 81 R; 4/622, 628; 401/6, 28, 183; 239/327; 222/209, 211; 134/198, 200; 15/104.92, 112, 113, 160, 161, 191 A, 31, 36, 97.2

[56] References Cited

U.S. PATENT DOCUMENTS

| | | | |
|---|---|---|---|
| D. 283,848 | 5/1986 | Miller | D4/120 |
| 2,591,331 | 4/1952 | Baumbach | 15/160 |
| 2,852,793 | 9/1958 | Shelton | 15/160 X |
| 3,543,747 | 12/1970 | Gustafson | 15/160 X |
| 3,548,439 | 12/1970 | Berst | 15/104.92 |
| 3,810,463 | 5/1974 | Krummenacher | 128/66 X |
| 3,939,825 | 2/1976 | Krummenacher | 128/66 X |
| 3,966,335 | 6/1976 | Abramson | 401/183 X |
| 3,973,286 | 8/1976 | Logan | 15/104.92 X |
| 4,520,525 | 6/1985 | Yogi et al. | 4/622 X |
| 4,532,668 | 8/1985 | Slonicki | 15/161 X |
| 4,610,040 | 9/1986 | Concato | 4/622 |
| 4,617,917 | 10/1986 | Miller | 128/62 |
| 4,918,779 | 4/1990 | Burns | 15/104.92 |

FOREIGN PATENT DOCUMENTS

| | | | |
|---|---|---|---|
| 2940410 | 4/1981 | Fed. Rep. of Germany | 4/622 |
| 562600 | 6/1975 | Switzerland | 4/622 |

*Primary Examiner*—Harvey C. Hornsby
*Assistant Examiner*—C. Cooley
*Attorney, Agent, or Firm*—Brown, Martin, Haller & McClain

[57] ABSTRACT

A personal hygiene device for cleaning the hands or feet has an outer enclosure of generally donut-like shape which forms an open ended cavity for receiving a user's hand or foot. The innermost surfaces of the enclosure which face inwardly into the cavity are covered with bristles. The enclosure has an internal reservoir within its walls for containing a suitable detergent or soap solution, and one or more outlet openings in the innermost surfaces of the enclosure are connected to the reservoir. A pump mechanism allows the user to pump fluid from the reservoir to the outlet openings, so that the user can move their hand or foot back and forth over the bristles to work up a cleansing lather.

10 Claims, 2 Drawing Sheets

PERSONAL HYGIENE DEVICE

BACKGROUND OF THE INVENTION

The present invention relates generally to hygiene devices for washing and cleaning purposes, and is particularly concerned with a device for scrubbing and cleaning body extremities such as the hands and feet.

Body extremities such as the hands and feet are difficult to clean thoroughly simply by soaping, particularly for individuals who work in areas where dirt or other soiling agents such as paint, oil, and the like are encountered, for example gardeners, painters, car mechanics, coal miners, and so on. Also, in some occupations, thorough cleaning of the hands is an important sanitary requirement, for example in the food and medical services. Scrubbing brushes are therefore often used as an aid in removing soil from the hands and other body parts. However, such brushes can be inconvenient and require a significant effort on the user's part.

Other types of foot washing or scrubbing devices for cleaning the feet have also been proposed in the past. For example, U.S. Pat. No. 4,610,040 of Concato describes an automatic foot washing and massaging machine in which motor driven rollers having bristles on their outer surfaces are moved back and forth over a person's foot or feet. The apparatus is seated in a basin which contains washing water. This device is relatively cumbersome and difficult to use. U.S. Pat. No. 4,617,917 of Miller describes a foot hygiene device comprising a base having a bristle or brush area on which the foot is placed, spaced side walls also covered with bristles on each side of the foot, and an upper wall extending over the top of the foot at one end of the brush area. The upper wall also has inwardly directed bristles and spaced extended tuft areas for cleaning between the toes. The device is intended to be placed in a bath tub or shower.

SUMMARY OF THE INVENTION

It is an object of the present invention to provide a new and improved personal hygiene device for cleaning body extremities such as the hands and feet.

According to the present invention, a personal hygiene device is provided which comprises an outer enclosure forming an open ended cavity for receiving a foot or hand, the enclosure having a base, side walls extending upwardly from each side of the base, and an arcuate upper wall. The enclosure has an internal reservoir for holding cleaning fluid, and a suitable inlet for supplying fluid to the reservoir, while the upper wall of the enclosure has an internal chamber connected to the reservoir via a passageway, the chamber having outlets communicating with the cavity. A pumping device is provided for pumping cleaning fluid from the reservoir to the chamber in the upper wall of the device, where it drips out of the outlets downwardly into the cavity. The inwardly facing surfaces of the enclosure surrounding the cavity are all covered with bristles.

In order to use the device, a person simply places one of their feet, for example, into the cavity and rubs the foot back and forth over the bristles while pumping cleaning fluid into the chamber in the upper wall, where it will drip out of the outlets and be distributed by the movement of the foot over the bristles to form a lather. The cleaning fluid may comprise any suitable detergent or soaping agent, for example, and may include additives such as disinfecting, anti-bacterial and/or anti-fungal agents. The cavity is of larger dimensions than the foot, and the user can clean all surfaces of the foot simply by placing them against the appropriate bristle covered surface and moving the foot back and forth to produce a scrubbing action.

In a preferred embodiment of the invention, the base of the enclosure is hollow and has spaced top and bottom walls forming the fluid reservoir, the top wall of the base being of resilient material to form a pumping member. The user simply pushes down repeatedly on the base with their foot, forcing fluid out of the reservoir and upwardly via the passageway into the upper chamber. After compressing the upper pump wall several times, movement of the foot back and forth through the cavity will create a lather for scrubbing and cleaning the foot.

Preferably, the side walls are rounded at their forward ends and bristles extend around the forward ends and onto the outer surfaces of the side walls to form a region for cleaning between the toes. The user simply urges the front end of their foot against the forward end of one of the side walls so that it extends into the space between two of their toes, then scrubs back and forth to clean that inter-digital area. The process is repeated to clean the space between each pair of toes in order to clean the foot thoroughly.

This device is totally self-contained and can be used on any suitable surface. The user does not need to bend over or lift their foot upward in order to clean it or apply soap, but simply places their foot into the cavity, pumps up and down a few times to produce a lather, and scrubs back and forth until the foot is completely clean. The device is suitable for use either in the home, health spa or in the work place.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
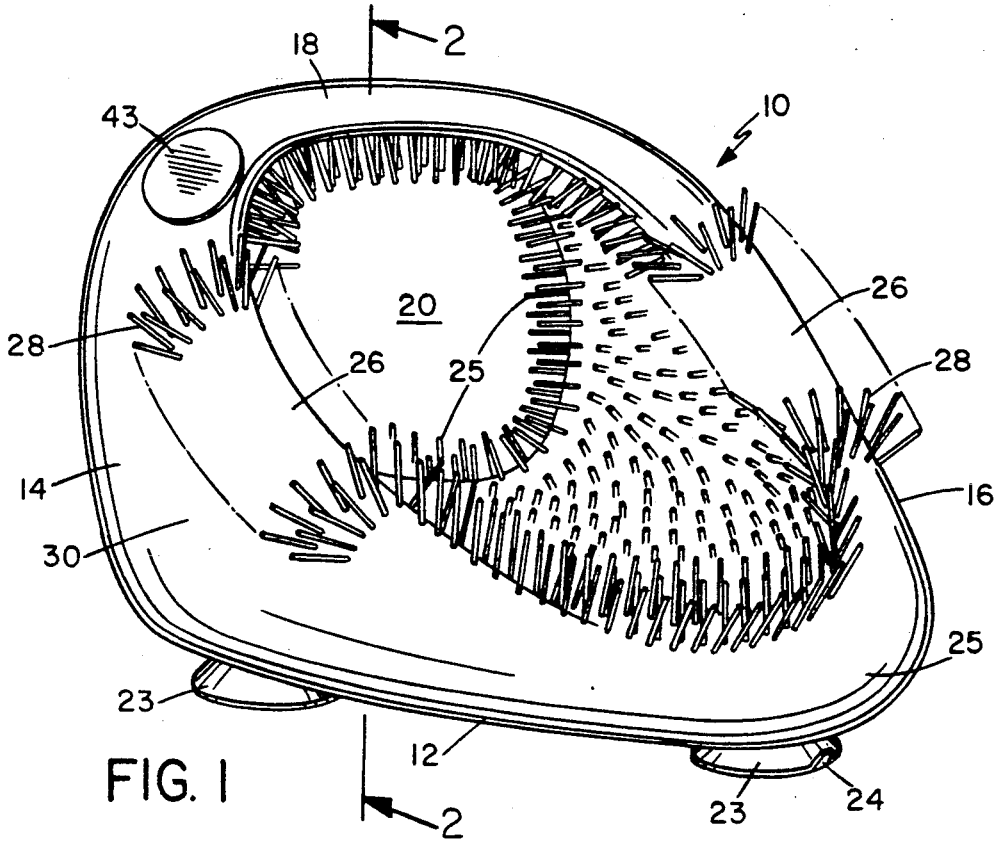
FIG. 1 is a perspective view of a personal hygiene device according to a preferred embodiment of the present invention.

The drawings illustrate a personal hygiene device 10 according to a preferred embodiment of the present invention. The device basically comprises an outer enclosure having a base 12, side walls 14, 16 extending upwardly from the base, and an upper arcuate wall 18 together forming an open ended cavity 20 for receiving a body extremity such as a hand or a foot 22. Suitable feet or supports such as spaced suction cups 23 are provided on the base for securing the base on a suitable horizontal surface such as the floor of a bathroom tub or shower or a counter adjacent a washbasin, for example. Preferably, three suction cups are provided and each cup has a projecting, seal-breaking finger tab 24 for easy release and removal of the device. The inwardly facing surfaces of the base, side and upper walls are all covered with bristles 25, which are permanently secured in suitable apertures in these surfaces in a standard fashion, for example as in a hairbrush or scrubbing brush. The bristles in the side walls extend over the forward ends 26 of these walls and also cover an area 28 on the outer surface 30 of each side walls.

Figure 4:
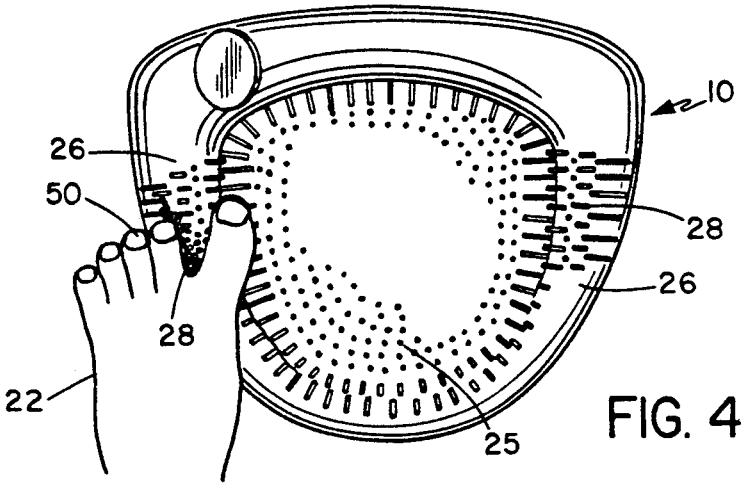
FIG. 4 is a top view of the device illustrating its use to clean between the toes.

The cavity is generally donut-shaped, and the base 12 is elongated to extend beyond upper wall 18 at its forward end. The base is preferably slightly shorter than the average foot length. All edges and surfaces of the enclosure are generally rounded or curved to reduce the risk of injury to a user, and the forward, bristle covered ends 26 of the side walls are of gradually tapering thickness to fit easily between a user's toes, as illustrated in FIG. 4. The side walls 14, 16 are tapered at their forward ends from the forward end of the base rearwardly to meet the forward end of the upper wall, forming a continuously-curved, rearwardly tapering opening leading into cavity 20, as best illustrated in FIGS. 1 and 2.

Figure 2:
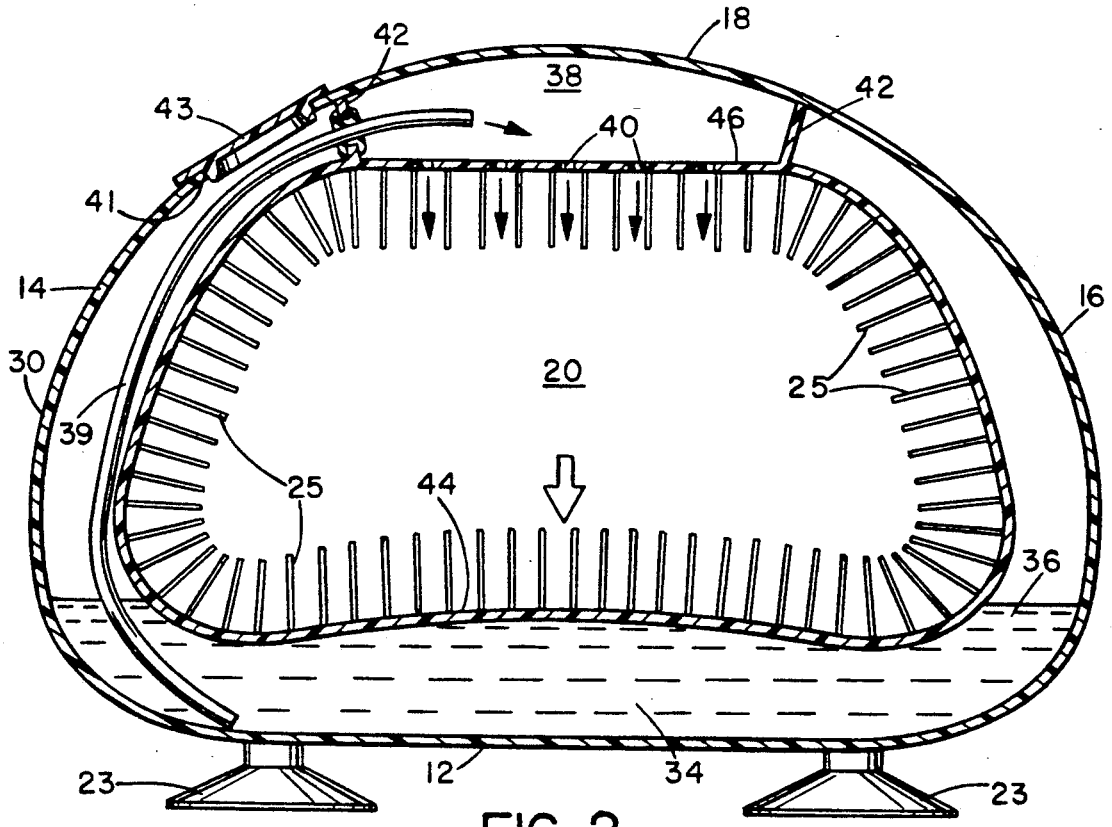
FIG. 2 is a cross section on the lines 2—2 of FIG. 1.

The enclosure is preferably completely hollow-walled, as illustrated in FIG. 2, with the hollow interior of the base 12 forming a reservoir 34 for holding a suitable cleaning fluid or detergent 36. The reservoir 34 is connected to a chamber 38 in the upper wall 18 via tubing 39, and spaced outlets 40 on the inner surface of upper wall 18 allow fluid in chamber 38 to drip into the cavity 20, as indicated by the arrows in FIG. 2. Barriers 42 at each end of chamber 38 prevent fluid from flowing out of the chamber into the hollow side walls. Preferably, outlets 40 are provided at spaced intervals over the entire inner surface of upper wall 18. Tubing 39 extends through barrier 42 at one end of the chamber 38. A suitable fill inlet 41 is provided on a top surface of the enclosure adjacent one of the barriers 42 for re-filling the reservoir when necessary, and a recessed snap fit cap 43 normally closes the inlet opening 41, as illustrated in FIG. 2. Alternatively, the side walls could be solid with separate chambers formed in the base and upper wall of the enclosure.

Fluid is pumped from reservoir 34 into the upper chamber 38 via a suitable pumping mechanism. This may comprise a separate siphon pump, but in the preferred embodiment illustrated the pumping mechanism is provided by a resilient or flexible top portion or wall 44 of base 12, which may be elevated or arched upwardly as illustrated in FIG. 2 when in its normal position. The user simply pushes down on flexible top wall or portion 44 of the reservoir several times to produce a pumping action, using either the hand or foot, and this forces fluid out of reservoir 34 upwardly via tubing 39 and into upper chamber 38. The bottom or inner wall portion 46 of the upper chamber 38 may slope downwardly slightly from the exit end of the tubing, as illustrated in FIG. 2, so that the solution or fluid will flow downwardly and be emitted substantially evenly from all of the outlets spaced over wall portion 46, rather than just from the outlets closest to the end of tubing 39.

The inner surfaces of the enclosure surrounding the cavity are all continuously rounded or curved, as best illustrated in FIG. 2, to provide bristles projecting inwardly at a range of different angles from the various areas of the cavity surrounding surfaces. This will accommodate the various curves, ridges and grooves of the hands and feet for effective cleaning. The bristle diameter and density may vary over the inner surfaces of the enclosure to provide a variety of scrubbing actions, from soft to hard. For example, the bristle diameter may increase gradually from the front or inlet end of the device to the back end, for example from 0.006 to 0.01 inches at the front to 0.02 to 0.04 at the rear end. The bristles may also be of varying lengths, and may be of natural or synthetic material.

The enclosure may be made entirely of molded plastic material, for example in two half sections which are suitably secured together. It may be provided in a range of different colors to match various bathroom color schemes.

Figure 3A:
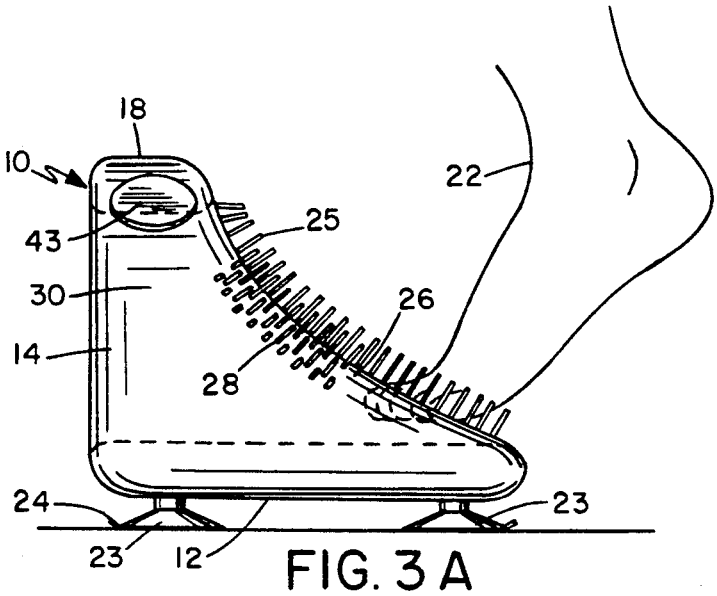
FIGS. 3(*a*) to 3(*c*) illustrate use of the device to clean outer surfaces of a person's foot.
Figure 3B:
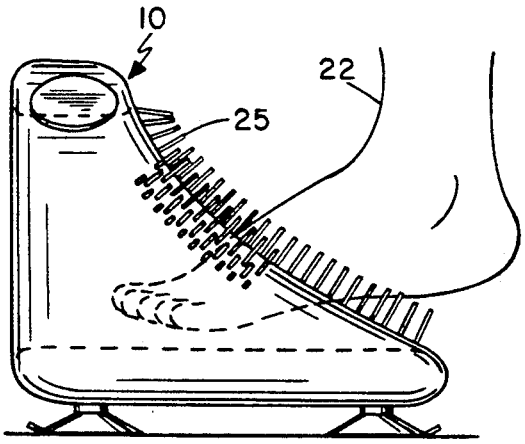
Figure 3C:
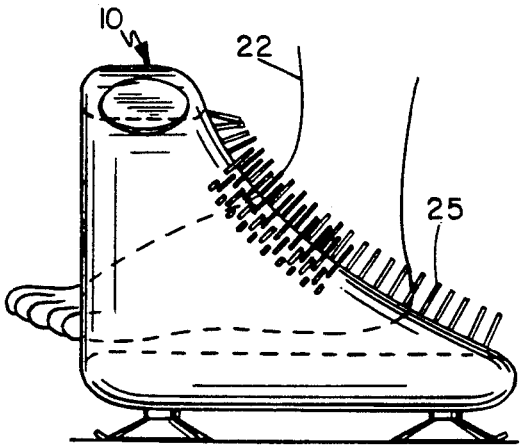

FIGS. 3(*a*) to 3(*c*) illustrate use of the device 10 to clean the foot 22, while FIG. 4 illustrates use of the device to clean an inter-digital area between the user's toes 50. As illustrated in FIG. 3(*a*), the user first inserts their foot 22 through the open forward end of the device, the sole of the foot rubbing over the bristle covered upper surface of the base 12. The user pushes their foot forwardly into cavity 20, until the position illustrated in FIG. 3(*c*) is reached. At this point the foot is pumped up and down several times, depressing the top wall of the fluid reservoir 34 and forcing cleaning fluid upwardly into the upper chamber 38, where it drips down out of the outlets and onto the person's foot. The foot is then scrubbed back and forth several times to work up a lather, and the user can scrub all outer surface regions of the foot easily over appropriate areas of the curved, bristle covered surfaces surrounding the cavity, until the foot is completely clean, pumping the top wall of the reservoir 36 as necessary to supply more detergent.

The user cleans the region between each pair of toes as illustrated in FIG. 4. The toes are urged against the curved front end 26 of one of the side walls with the front end 26 extending into one of the inter-digital areas as illustrated in FIG. 4. The foot is then moved back and forth to scrub the region between the toes, and the process is repeated until all inter-digital areas have been cleaned. A similar procedure may be used for scrubbing and cleaning the hands. The cleaning fluid may contain additives such as disinfecting or other anti-bacterial agents, or anti-fungal agents, as well as an anti-lime compound for reduction or prevention of lime deposit build up in and around the device.

In this way the hands and/or feet can be thoroughly cleaned and disinfected relatively quickly and conveniently. The cleaning device is relatively compact and is completely self contained, and the user does not need to apply soap or water separately before using the device. It can be used in private or public bathrooms. The device may be secured via the suction cups to any convenient surface such as a basin, sink, tub or shower. It allows a foot to be cleaned without needing either to bend over or lift the foot to apply soap. In addition to providing convenient scrubbing and cleaning surfaces, the sloping, curved internal surfaces of the enclosure also promote rapid draining and drying of liquid when the device is not in use. The device is suitable for both home and professional use, particularly in professions requiring thorough hand disinfection, such as the medical, dental, and food service professions, for example.

Although a preferred embodiment of the invention has been described above by way of example only, it will be understood by those skilled in the field that modifications may be made to the disclosed embodiment without departing from the scope of the invention, which is defined by the appended claims.

I claim:

1. A personal hygiene device for cleaning body extremities such as feet and hands, comprising:

an enclosure having a base member, spaced side wall members extending upwardly from the base member, and an arcuate upper wall member extending between the upper ends of the side wall members, each of the members having spaced inner and outer walls forming an internal hollow region in each of the members and the members together forming an open ended cleaning cavity for receiving a hand or foot, the inner walls of said members having inner surfaces facing inwardly into said cleaning cavity;

a plurality of bristles secured directly to the inwardly facing surfaces of the base side wall and upper wall members to project inwardly into said cavity from said members;

the hollow region between the inner and outer wall of at least one of said members comprising an internal reservoir for holding a cleaning fluid, and the enclosure having a fill inlet for supplying fluid to the reservoir;

the hollow region in the upper wall member comprising a fluid distributing chamber and the upper wall member having outlets communicating with the chamber spaced along the inner wall of the upper wall member for supplying cleaning fluid from the chamber to the cleaning cavity;

the enclosure having a passageway connecting the internal reservoir to the fluid distributing chamber; and pump means for pumping cleaning fluid from the reservoir to the fluid distributing chamber.

2. The device as claimed in claim 1, wherein the cleaning cavity has a forward end and a rearward end, wherein the base member extends forwardly beyond a forward end of the upper wall member.

3. The device as claimed in claim 1, wherein said reservoir is located in said base member and said pump means comprises a flexible top wall of said reservoir arranged to be pushed down by a user's foot to produce a pumping action.

4. The device as claimed in claim 3, wherein the flexible top wall of said reservoir is arched upwardly.

5. The device as claimed in claim 1, wherein the side wall members have curved forward ends shaped for fitting between a user's digits, and spaced bristles are mounted over the forward ends of the side wall members and on part of the outer surface of the side wall members adjacent the forward ends to provide scrubbing surfaces for scrubbing between the digits.

6. The device as claimed in claim 1, wherein the inner and outer surfaces of the entire enclosure are curved.

7. The device as claimed in claim 1, including mounting means on the base member for releasably mounting the enclosure on a flat surface.

8. The device as claimed in claim 7, wherein the mounting means comprise suction cups.

9. A personal hygiene device for cleaning body extremities such as feet and hands, comprising:

an enclosure having a base member, spaced side wall members extending upwardly from the base member, and an arcuate upper wall member extending between the upper ends of the side wall members, the members together forming an open ended cavity for receiving a hand or foot, the members each having spaced inner and outer walls forming an internal hollow region in each of the members, the inner walls of the members having inner surfaces facing inwardly into said cavity;

a plurality of bristles secured directly to said inner surfaces of the base, side walls and upper wall members to project inwardly into said cavity;

at least one of said hollow regions in said members including an internal reservoir for holding a cleaning fluid, and a fill inlet for supplying fluid to the reservoir;

the hollow region in said upper wall member comprising a fluid distributing chamber and the upper wall member having outlets communicating with the chamber spaced along the inner wall of the upper wall member for supplying cleaning fluid from the chamber to the cavity;

a passageway connecting the internal reservoir to the fluid distributing chamber;

pump means for pumping cleaning fluid from the reservoir to the fluid distributing chamber;

the cavity having a forward end and a rearward end, the base member extending outwardly beyond a forward end of the upper wall member, and the side wall members having forward ends which taper gradually from the forward end of the upper wall member to a forward end of the base member; and said reservoir comprising the hollow region in the base member of said enclosure, and said enclosure having internal barriers at each side of the hollow region within the upper wall member to define said fluid distributing chamber, said passageway comprising a tube extending from said reservoir upwardly through one side wall member and through one of said barriers into said fluid distributing chamber.

10. A personal hygiene device for cleaning body extremities such as feet and hands, comprising:

a housing having a base member, spaced side wall members extending upwardly from the base member, and an arcuate upper wall member extending between the upper ends of the side wall members to form an open-ended cleaning cavity for receiving a body extremity, said members having inwardly facing surfaces facing inwardly into said cleaning cavity;

a plurality of bristles secured directly to the inwardly facing surfaces of said base, side wall and upper wall members to cover at least a major portion of the surface area of said inwardly facing surfaces, the bristles projecting inwardly into said cleaning cavity;

the base member having spaced inner and outer walls forming a closed internal cavity comprising a reservoir for holding a cleaning fluid, the housing having a fill inlet connected to said reservoir;

the upper wall member having spaced inner and outer walls forming an internal cavity comprising a fluid distributing chamber, the inner wall of said upper wall member having a plurality of fluid distribution outlet openings connected to said fluid distributing chamber for distributing cleaning fluid from said chamber to said cleaning cavity;

the housing having an internal passageway connecting said reservoir to said fluid distributing chamber; and pump means for pumping cleaning fluid from the reservoir to the fluid distributing chamber.

* * * * *